US007360887B2

(12) United States Patent
Konno

(10) Patent No.: US 7,360,887 B2
(45) Date of Patent: Apr. 22, 2008

(54) IMAGE FORMING APPARATUS AND METHOD

(75) Inventor: Masaaki Konno, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 293 days.

(21) Appl. No.: 11/088,187

(22) Filed: Mar. 24, 2005

(65) Prior Publication Data

US 2005/0212852 A1 Sep. 29, 2005

(30) Foreign Application Priority Data

Mar. 25, 2004 (JP) ..... 2004-090258

(51) Int. Cl.
*B41J 2/01* (2006.01)

(52) U.S. Cl. ..... 347/103; 347/104; 347/99; 347/102; 347/101

(58) Field of Classification Search ..... 347/88, 347/99, 101–105, 5, 14
See application file for complete search history.

(56) References Cited

U.S. PATENT DOCUMENTS

| | | | | |
|---|---|---|---|---|
| 4,449,838 | A * | 5/1984 | Okamura et al. | 400/234 |
| 4,893,952 | A * | 1/1990 | Svyatsky | 400/470 |
| 5,502,476 | A * | 3/1996 | Neal et al. | 347/103 |
| 6,126,274 | A * | 10/2000 | Kohyama | 347/55 |
| 6,390,617 | B1 * | 5/2002 | Iwao | 347/102 |
| 2002/0075365 | A1 * | 6/2002 | Fujimoto et al. | 347/85 |
| 2003/0081096 | A1 * | 5/2003 | Young | 347/102 |
| 2003/0143007 | A1 * | 7/2003 | Vives et al. | 400/82 |
| 2004/0032477 | A1 * | 2/2004 | Baker et al. | 347/102 |
| 2005/0099479 | A1 * | 5/2005 | Mizutani et al. | 347/103 |

FOREIGN PATENT DOCUMENTS

| | | | |
|---|---|---|---|
| JP | 9-314867 | A | 12/1997 |
| JP | 10-250052 | A | 9/1998 |
| JP | 2000-141621 | A | 5/2000 |

(Continued)

*Primary Examiner*—Matthew Luu
*Assistant Examiner*—Joshua M Dubnow
(74) *Attorney, Agent, or Firm*—Birch, Stewart, Kolasch & Birch, LLP

(57) ABSTRACT

The image forming apparatus comprises: a first inkjet head which ejects ink for forming a first image to be recorded on a recording medium; a first intermediate transfer medium on which the first image is formed by the ink ejected from the first inkjet head, the first intermediate transfer medium having a structure that includes an elastic body in a first image formation area in which the first image is formed; a second inkjet head which ejects ink for forming a second image to be recorded on the recording medium; a second intermediate transfer medium on which the second image is formed by the ink ejected from the second inkjet head, the second intermediate transfer medium having a structure that includes an elastic body in a second image formation area in which the second image is formed; and a transfer recording device which transfers and records the first image and the second image to a first surface of the recording medium in contact with the first image formation area and a second surface of the recording medium in contact with the second image formation area, while holding the recording medium between the first intermediate transfer medium and the second intermediate transfer medium, and conveying the recording medium with respect to the first intermediate transfer medium and the second intermediate transfer medium.

14 Claims, 7 Drawing Sheets

FOREIGN PATENT DOCUMENTS

| | | | |
|---|---|---|---|
| JP | 2000-272111 | A | 10/2000 |
| JP | 2002-55586 | A | 2/2002 |
| JP | 2003-80688 | A | 3/2003 |
| JP | 2003080688 | * | 3/2003 |
| JP | 2003-266802 | A | 9/2003 |

* cited by examiner

IMAGE FORMING APPARATUS AND METHOD

BACKGROUND OF THE INVENTION

1. Field of the Invention

The present invention relates to an image forming apparatus and an image forming method, and more particularly to a double-sided image forming technique for forming a desired image on both sides of a recording medium.

2. Description of the Related Art

In recent years, inkjet printers are becoming more widely used as data output apparatuses for images, documents, and other forms of data. Inkjet printers drive nozzles or other recording elements provided to a print head in accordance with data, and data can be formed on recording paper or another recording medium by ink ejected from the nozzles.

An inkjet printer moves a recording medium and a print head having a large number of nozzles in relation to each other, and an image is formed on the recording paper by ejecting ink droplets from the nozzles.

Conventionally, inkjet printers have been used as an output medium for small-sized, small-scale printing such as documents with a size of about an A4 sheet of paper in offices, homes, and other locations. Because of advances in high-speed, high-quality printing in recent years, however, it has become possible to print large-sized media of A3 size or larger at high speed, and to print photo-sized, high quality images taken with a digital camera or another electronic camera.

There are also inkjet printers that can be used to print both sides and handle various recording papers so that pamphlets and magazines can be created.

There are also inkjet printers that handle double-sided printing by adopting a method whereby one side is printed, the paper is thereafter reversed, and the other side is printed.

In the inkjet printer described in Japanese Patent Application Publication No. 2000-272111, the apparatus is configured with a first head unit for discharging ink to one side of the conveyed recording paper, and a second head unit for discharging ink to the other side so that an image can be recorded to both sides of the recording paper.

In the inkjet double-sided print method and apparatus described in Japanese Patent Application Publication No. 2003-80688, the apparatus is configured to discharge ink simultaneously from two left and right inkjet apparatuses to two left and right blankets disposed in correspondence with the inkjet apparatuses to form a design, paper is passed between the two blankets, and the design formed on the blankets is transferred to both sides of the paper.

However, the method in which printing is carried out on one side, the paper is reversed, and the other side is then printed is not suitable for high-speed printing because the time normally required to print two pages is needed to print a single page. A mechanism for automatically reversing paper is also required. Furthermore, the image quality is liable to be degraded by ink transfer, soiling, and other drawbacks when printing is carried out on the other side without the ink being adequately fixed on the previously printed side.

In the inkjet printer described in Japanese Patent Application Publication No. 2000-272111, it is difficult to assure positional accuracy between the two head groups and the recording medium depending on the quality and thickness of the printing medium. Also, it is impossible to ignore force applied in the gravitational direction because at least one of the head groups does not discharge downward, and it becomes difficult to match the image conditions between the front and reverse sides.

In the inkjet double-sided print method and apparatus described in Japanese Patent Application Publication No. 2003-80688, there is a possibility that ink will not be stably transferred and fixed on the paper, and the quality of the resulting image is liable to considerably vary depending on the type and thickness of the paper.

SUMMARY OF THE INVENTION

The present invention has been contrived in view of such circumstances, and an object thereof is to provide an image-forming apparatus and image-forming method that realize high-speed, high-quality double-sided image recording.

In order to attain the aforementioned object, the present invention is directed to an image forming apparatus, comprising: a first inkjet head which ejects ink for forming a first image to be recorded on a recording medium; a first intermediate transfer medium on which the first image is formed by the ink ejected from the first inkjet head, the first intermediate transfer medium having a structure that includes an elastic body in a first image formation area in which the first image is formed; a second inkjet head which ejects ink for forming a second image to be recorded on the recording medium; a second intermediate transfer medium on which the second image is formed by the ink ejected from the second inkjet head, the second intermediate transfer medium having a structure that includes an elastic body in a second image formation area in which the second image is formed; and a transfer recording device which transfers and records the first image and the second image to a first surface of the recording medium in contact with the first image formation area and a second surface of the recording medium in contact with the second image formation area, while holding the recording medium between the first intermediate transfer medium and the second intermediate transfer medium, and conveying the recording medium with respect to the first intermediate transfer medium and the second intermediate transfer medium.

According to the present invention, the first image formed on the first intermediate transfer medium by ink ejected from the first inkjet head, and the second image formed on the second intermediate transfer medium by ink ejected from the second inkjet head can be simultaneously transferred to the surfaces in contact with first intermediate transfer medium and second intermediate transfer medium of the recording medium by using a transfer recording device. High-speed, double-sided recording can be carried out when the first surface of one sheet of recording medium makes contact with the first intermediate transfer medium, and the second surface makes contact with the second intermediate transfer medium.

Also, when performing double-sided image recording, the discharge direction of the ink that forms an image on surfaces can be made the same.

On the other hand, the first intermediate transfer medium and the second intermediate transfer medium can absorb irregularities and other undesirable features in the surface of the recording medium, and improve the transferability of the ink because the first image formation area and the second image formation area in which the image is formed by ink ejected from at least the inkjet heads have a structure that includes an elastic body. Image offset and cockling can furthermore be avoided.

The intermediate transfer medium is provided with a transfer belt, a transfer roller, and other components, and a prescribed strength; and has ink resistance and flatness that allows images to be formed with ink on the surface thereof. Members composed of materials with adequate release characteristics with respect to the ink to be used are selected. Test materials may include silicone, rubber, and other materials. Silicone oil and other fluids that augment the release characteristics may be applied to the surface of the intermediate transfer medium in order to improve the release characteristics with respect to ink.

The recording medium is a medium (media) to which ink droplets are ejected from a print head, and more specifically includes continuous paper, cut paper, seal paper, and other types of paper, OHP sheets and other resin sheets, as well as film, cloth, and various other media without regard to materials or shapes. The term "recording medium" may also refer as an image formation medium, printing medium, image-receiving medium, and the like.

The term "inkjet head" includes a full-line head having rows of discharge holes with a length that corresponds to the entire width of the intermediate transfer medium, and a serial head (shuttle scan head) in which a short head scans a plurality of times over an intermediate medium and ejects ink. The present invention may be applied to the above-described heads.

The inkjet head may include a multicolor head in which heads corresponding to each color are arranged.

The term "image" as used in the present specification refers to a broad meaning of the concept that includes illustrations, pictures, and other depictions, and additionally characters, symbols, lines, and the like. In other words, this includes images, documents, designs, and the like that can be recorded on a recording medium with an inkjet recording apparatus or another image forming apparatus.

Preferably, ink discharge directions of the first inkjet head and the second inkjet head are substantially vertically downward, and the first image formation area and the second image formation area form substantially horizontal planes. According to this, since the first and second image formation areas have a horizontal flatness, the discharge conditions of the inkjet heads can be made substantially the same, and the configuration is advantageous when superimposing ink.

The first inkjet head and the second inkjet head may include a multicolored head in which heads corresponding to each color are arrayed. The use of a multicolored head is advantageous when superimposing colors.

Preferably, the image forming apparatus further comprises a preliminary curing device which cures the ink ejected to the first intermediate transfer medium and the second intermediate transfer medium to a semiliquid state with a such viscosity at which mixing with ink of other colors does not occur. According to this, bleeding, color mixing, and other image distortions on the intermediate transfer media can be prevented and transferability to the recording medium can be improved by placing the ink ejected onto the intermediate transfer media in a semiliquid state.

The semiliquid state indicates a viscous state in which the ink droplets do not mix with the inks of another color on the intermediate transfer medium, and when the ink droplets land on the intermediate transfer medium, and the ink droplets are held (fluid does not move from the landing position) on the surface of the intermediate transfer medium. When an image on the intermediate transfer medium is transferred to the recording medium, the preferred state is one in which the ink droplets are reliably separated from the surface of the intermediate transfer medium.

Preferably, the ink ejected in a molten state from the first inkjet head and the second inkjet head contains a thermal phase-change ink; and the preliminary curing device comprises a heating device which heats at least the first and second image formation areas for keeping the ink ejected to the first and second image formation areas in the semiliquid state. According to this, since the semiliquid state of the ink deposited on the first and second intermediate transfer media can be maintained when the first and second intermediate transfer media are brought to the semiliquid temperature of the deposited ink using a thermal phase-change ink, image distortion when the ink is deposited can be prevented, and the release of the ink during transfer can be assured.

Alternatively, it is also preferably that the ink ejected from the first and second inkjet heads contains photocurable ink; and the preliminary curing device comprises an optical radiation curing device which irradiates at least the first and second image formation areas with light that cures the photocurable ink to cure the ink ejected to the first and second image formation areas in the semiliquid state. According to this, using photocurable ink, light for curing ink is directed to the ink ejected to the intermediate transfer media, and the ink on the surface of the intermediate transfer medium can be preliminarily cured. UV inks may be used as the photocurable ink. Other than UV inks, it is also possible to use ink that is cured by irradiating energy that is similar to light.

Preferably, the image forming apparatus further comprises a main curing device which cures the ink transferred from the first intermediate transfer medium and the second intermediate transfer medium to the recording medium so that the image is not degraded on the recording medium due to conveyance handling. According to this, since the ink transferred to the recording medium in a semiliquid state is reliably fixed, the image quality is stable. Also, the ink ejected to the first intermediate transfer medium and the second intermediate transfer medium is not reduced, and ink offsetting and cockling do not occur.

Preferably, the ink ejected in a molten state from the first inkjet head and the second inkjet head contains a thermal phase-change ink; the preliminary curing device comprises a heating device which heats at least the first and second image formation areas for keeping the ink ejected to the first and second image formation areas in the semiliquid state; and the main curing device comprises a cooling device which cools the recording medium to fix ink transferred to the recording medium thereto. The primary fixing of ink transferred onto the recording medium can be carried out using the cooling device, and the stability of the image quality recorded on the recording medium can be assured.

A preferred aspect provides a temperature measurement device for measuring the temperature of the first and second intermediate transfer media and the recording medium, and provides a temperature control device for controlling the heating curing device and cooling fixing device so that the temperature of the intermediate transfer media and the recording medium is brought to a prescribed range.

Alternatively, it is also preferable that the ink ejected from the first and second inkjet heads contains photocurable ink; the preliminary curing device comprises an optical radiation curing device which irradiates at least the first and second image formation areas with light that cures the photocurable ink to cure the ink ejected to the first and second image formation areas in the semiliquid state; and the main curing device comprises an optical radiation fixing device which irradiates the recording medium with light that cures the photocurable ink for fixing the ink transferred onto the recording medium to the recording medium. It is furthermore possible to direct light on the ink ejected to the recording medium and to carry out primary fixing of the ink on the recording medium.

Preferably; the transfer recording device comprises a pressure adjustment mechanism which varies a pressure for holding the recording medium between the first intermediate transfer medium and the second intermediate transfer medium; and the image forming apparatus further comprises a pressure control device which controls the pressure adjustment mechanism in accordance with at least one parameter of a type of recording medium, a thickness of the recording medium, and a discharge amount of the ink. According to this, since at least one parameter selected from the type recording medium, the thickness of the recording medium, and the discharge amount of ink is determined, and the pressure for holding the recording medium between the first and second intermediate transfer media is varied in accordance with the determination result, the stability of the image quality recorded on the recording medium can be assured even if the thickness of the recording medium or the evenness (type) of the surface changes.

Preferably, the image forming apparatus further comprises: a recording mode selection device which selects whether to carry out single-sided recording that records on one surface of the recording medium, or to carry out double-sided recording that records on both surfaces of the recording medium, wherein the pressure control device controls the pressure adjustment mechanism in accordance with a selection result of the recording mode selection device. According to this, the stability of the image quality can be assured during single-sided recording for recording to a single surface of the recording medium, and during double-sided recording for recording to both surfaces of the recording medium.

The recording mode selection device for selecting whether to carrying out single-sided or double-sided recording may be configured so that the recording mode is selected by operating a switch or the like, or selected by software from a menu screen or the like.

Preferably, the pressure control device controls the pressure adjustment mechanism to bring the first intermediate transfer medium and the second intermediate transfer medium into a non-pressurized state when at least one of the first inkjet head and the second inkjet head is not recording an image and is carrying out maintenance ejection. According to this, the intermediate transfer medium is detachably controlled so that the intermediate transfer media is brought to a non-pressurized state when purging or carrying out other maintenance ejections from the print head.

In order to attain the aforementioned object, the present invention is also directed to an image forming method for recording an image to a recording medium, comprising: a first image formation step for forming at least a first image on a first intermediate transfer medium which comprises an elastic body in a first image formation area in which at least the first image is formed using a first inkjet head from which ink that forms the first image recorded on the recording medium is ejected; a second image formation step for forming at least a second image on a second intermediate transfer medium which comprises an elastic body in a second image formation area in which at least the second image is formed using a second inkjet head from which ink that forms the second image recorded on the recording medium is ejected; and a transfer step for simultaneously transferring to both sides of the recording medium the first image formed by the first image formation step and the second image formed by the second image formation step while the recording medium is conveyed in a relative fashion with respect to the first intermediate transfer medium and the second intermediate transfer medium, with the recording medium held between the first intermediate transfer medium and the second intermediate transfer medium.

Preferably, two recording media are overlaid and conveyed between the first intermediate transfer medium and the second intermediate transfer medium, and images are substantially simultaneously transferred from the first intermediate transfer medium to one of the two recording media, and from the second intermediate transfer medium to the other of the two recording medium. According to this, by overlaying two sheets of recording media and holding them between the intermediate transfer media with pressure between the intermediate transfer media, it is possible to print simultaneously to the surfaces of the two recording media in contact with the first and second intermediate transfer media, and improved productivity can be expected. The images formed on the intermediate transfer media may be the same image or different images.

The configuration may be provided with a recording mode switching (selection) device for switching between the double-sided recording mode for double-sided recording and the two-sheet simultaneous recording mode for simultaneously recording two sheets, and the recording medium supply device may be automatically controlled so that a single recording medium is held between the first and second intermediate transfer media when the double-sided recording mode is set, and so that two recording media are held between the intermediate transfer media when the two-sheet simultaneous recording mode is set.

Preferably, the image forming method further comprises: a recording media quantity selection step for selecting whether a quantity of recording media inserted between the first intermediate transfer medium and the second intermediate transfer medium is a single sheet or two sheets, and a pressure adjustment step for adjusting a pressure between the first intermediate transfer medium and the second intermediate transfer medium in accordance with a selection result of the recoding media quantity selection step. According to this, since the pressure of the first and second intermediate transfer media is automatically controlled depending on whether the number of recording media is one sheet or two sheets, the image quality is stable irrespective of the number of recording media.

In accordance with the present invention, a first image to be recorded on the recording medium is formed on the first intermediate transfer medium by ink ejected from the first print head to the first intermediate transfer-medium, and a second image to be recorded on the recording medium is formed on the second intermediate transfer medium by ink ejected from the second print head. Since a recording medium is held between the first and second intermediate transfer media and an image formed on the first and second intermediate transfer media is transferred to the surfaces in contact with the first and second intermediate transfer media as the recording medium is conveyed in a relative fashion with respect to the intermediate transfer media, an image is simultaneously formed on both sides with a single recording action when one surface of a single sheet of recording medium makes contact with the first intermediate transfer medium and the other surface makes contact with the second intermediate transfer medium, making it possible to carry out high-speed, double-sided recording.

Of the intermediate transfer media, at least the image formation area to which ink is ejected is configured so as to include an elastic body, and since image distortion is therefore unlikely to occur even if the recording medium is uneven or has other irregularities, transferability is stable and high image quality can be obtained.

Since the configuration is provided with a pressure control device for varying the pressure between the intermediate transfer media, and the pressure can be varied in accordance with the type (material, thickness, and other parameters) and number of recording media, the image quality is stable even if the recording medium changes, and image quality is stable for single-sided or double-sided recording.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

Figure 1:
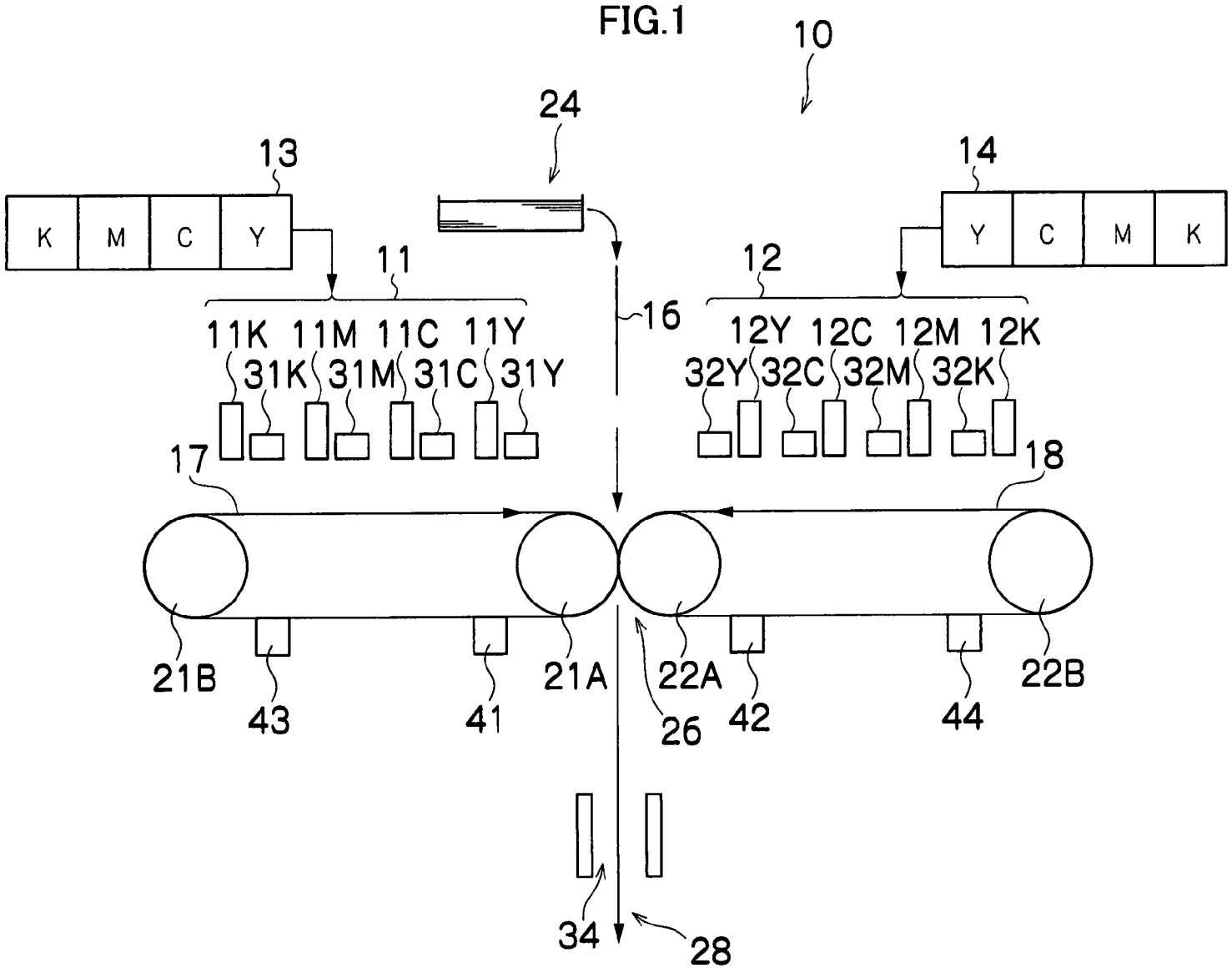
FIG. 1 is a general schematic drawing of an inkjet recording apparatus according to an embodiment of the present invention.

FIG. 1 is a general schematic drawing of an inkjet recording apparatus according to an embodiment of the present invention. As shown in FIG. 1, the inkjet recording apparatus 10 is provided with a first head group 11 having a plurality of print heads 11K, 11C, 11M, and 11Y provided for each color of ink; a second head group 12 having print heads 12K, 12C, 12M, and 12Y; an ink storing and loading unit 13 for storing ink to be fed to the print heads 11K, 11C, 11M, and 11Y incorporated in the first head group 11; an ink storing and loading unit 14 for storing ink to be fed to the print heads 12K, 12C, 12M, and 12Y incorporated in the second head group 12; a first transfer belt 17 on which an image is formed by ink ejected from the first head group 11 and which is used for transferring the image to the first surface of a recording medium 16; and a second transfer belt 18 on which an image is formed by ink ejected from the second head group 12 and which is used for transferring the image to the second surface of a recording medium 16.

The surface facing the first head group 11 of the first transfer belt 17 and the surface facing the second head group 12 of the second transfer belt 18 are disposed so as to be positioned in substantially the same plane. The first head group 11 and the second head group 12 are disposed so that the ink ejected from the first head group 11 and the second head group 12 is ejected substantially vertically downward.

The first transfer belt 17 has a structure in which both ends thereof are wound about rollers 21A and 21B, and the first transfer belt 17 is driven in the clockwise direction in FIG. 1 by the motive power of a motor 88 (not shown in FIG. 1, but shown in FIG. 5) transmitted to at least one of the rollers 21A and 21B. The belt moves from left to right in FIG. 1 on the side facing the first head group 11.

In a similar fashion, the second transfer belt 18 is wound about rollers 22A and 22B, and the second transfer belt 18 is driven in the counterclockwise direction in FIG. 1 by the motive power of the motor 88 (not shown in FIG. 1, but shown in FIG. 5) transmitted to at least one of the rollers 22A and 22B, and is moved from right to left in FIG. 1 on the side facing the second head group 12.

In other words, the first head group 11 and the second head group 12 have the same configuration, and the first transfer belt 17 and the second transfer belt 18 have the same configuration. Two images are formed using two image formation systems composed of the same configuration.

As shown in FIG. 1, the first transfer belt 17 and the second transfer belt 18 are disposed so that the roller 21A and roller 22A face each other along the movement direction of the transfer belts.

The recording medium 16 fed from the paper supply unit 24 is held between the first transfer belt 17 and the second transfer belt 18 by pressure mutually applied by the two facing rollers 21A and 22A, and is configured so as to be conveyed in a relative fashion with respect to the first transfer belt 17 and the second transfer belt 18 in synchronization with the rotation of the rollers 21A and 22A.

The image formed on the first transfer belt 17 and the second transfer belt 18 is transferred to the recording medium 16 as the recording medium 16 is pressed by the rollers 21A and 22A. In other words, the recording medium 16 is held between the first transfer belt 17 and the second transfer belt 18, the image formed on the first transfer belt 17 is transferred to the front side of the recording medium 16, the image formed on the second transfer belt 18 is transferred to the reverse side of the recording medium 16 in the transfer area 26 that receives pressure produced by the rollers 21A and 22A, and the images are thereby simultaneously formed on both surfaces of the recording medium 16 when the recording medium 16 makes a single pass through the transfer area 26. That is to say, the rollers 21A and 22A function as transfer rollers in the transfer area 26.

The inkjet recording apparatus 10 is provided with a pressure adjustment mechanism 108 (not shown in FIG. 1, but shown in FIG. 5) for varying the transfer pressure applied to the recording medium 16 by the rollers 21A and 22A.

In other words, the transfer pressure applied to the recording medium 16 by the rollers 21A and 22A can be varied in accordance with the type, thickness, surface irregularity, and other parameters of the recording medium 16. Metal, resin, and other thin plates, as well as cloth, leather, and other various types of media may be used as the recording medium 16, in addition to cut paper, continuous paper, and other types of paper.

The aspect in which the transfer pressure is varied may be implemented by varying the spacing between the rollers, or by varying the pressure applied between the rollers. It is also naturally possible to vary the spacing between the rollers and to vary the pressure applied between the rollers. The tension of the transfer belts may be varied, or the urging force (elastic force) imparted to the rollers 21A and 22A may be varied in order to vary the pressure applied between the rollers.

Furthermore, since at least the ink receiving area of the first transfer belt 17 and the second transfer belt 18 to which ink is ejected from the print head is formed with an elastic body, a structure is provided in which the thickness, surface irregularity, and other attributes of the recording medium 16 are cushioned when an image is transferred to the recording medium 16, and adequate transfers can be carried out even in cases in which a variety of recording media is used. The entire first transfer belt and second transfer belt may naturally be composed of an elastic body.

The printed recording medium (printed matter) 16 on which images have been formed on both sides in this manner is ejected from the paper discharge unit 28 to the exterior of the inkjet recording apparatus 10. Although not shown in FIG. 1, the paper discharge unit 28 holding the printed images is provided with a sorter for collecting the images for each print order.

Preliminary curing devices 31 and 32 for preliminarily curing the ink ejected onto the transfer belts are provided to the downstream side in the movement direction of the transfer belts of the print heads. In other words, preliminary curing devices 31K, 31C, 31M, and 31Y are provided to the downstream side (right side of the print heads 11K, 11C, 11M, and 11Y in FIG. 1) in the movement direction of the first transfer belt 17 of the print heads 11K, 11C, 11M, and 11Y incorporated in the first head group 11.

In a similar fashion, preliminary curing devices 32K, 32C, 32M, and 32Y are provided to the downstream side (left side of the print heads 12K, 12C, 12M, and 12Y in FIG. 1) in the movement direction of the second transfer belt 18 of the print heads 12K, 12C, 12M, and 12Y incorporated in the second head group 12.

As an example of the preliminary curing device, heaters can be used as the preliminary curing devices 31 and 32 when a thermal phase-change ink is used as the ink that forms the image. The ink is brought to a molten state in the head at the time of discharge and is then ejected, the temperature of the transfer belt surfaces is increased and the semiliquid temperature of the ink is maintained with the heaters, and the ink deposited on the first transfer belt 17 and the second transfer belt 18 is brought to a semiliquid state with a viscosity at which mixing with other colors does not occur. By bringing the ink ejected onto the transfer belts to a semiliquid state, bleeding and other image degradations are prevented from occurring in the images formed on the transfer belts. Also, ink does not remain on the surface of the first transfer belt 17 and the second transfer belt 18 when the ink is transferred from the first transfer belt 17 and the second transfer belt 18 to the recording medium 16, and the transfer performance to the recording medium 16 can be improved. Since the transfer performance to the recording medium 16 worsens if the ink on the first transfer belt 17 and the second transfer belt 18 completely solidifies, the configuration may be set so as to vary the temperature of the first transfer belt 17 and 18 in accordance with the type of recording medium and the amount of ink transferred (ejected).

The aspect in which the temperature of the first transfer belt 17 and the second transfer belt 18 is increased by the heater may be modified so that hot air is blown from the heater to the first transfer belt 17 and the second transfer belt 18, or that a heater is housed inside the first transfer belt 17 and the second transfer belt 18.

An aspect in which preliminary curing devices are provided to the print heads is exemplified in FIG. 1, but a preliminary curing device may be provided in common on the downstream side in the movement direction of the transfer belts of the print heads.

In FIG. 1, a single magazine for rolled paper (continuous paper) is shown as an example of the paper supply unit 24; however, a plurality of magazines with paper differences such as paper width and quality may be jointly provided. Moreover, paper may be supplied with a cassette that contains cut paper loaded in layers and that is used jointly or in lieu of a magazine for rolled paper.

In the case of a configuration in which a plurality of types of recording paper can be used, it is preferable that an information recording medium such as a bar code and a wireless tag containing information about the type of paper is attached to the magazine, and by reading the information contained in the information recording medium with a predetermined reading device, the type of paper to be used is automatically determined, and ink-droplet ejection is controlled so that the ink-droplets are ejected in an appropriate manner in accordance with the type of paper.

The recording medium 16 delivered from the paper supply unit 24 retains curl due to having been loaded in the magazine. In order to remove the curl, heat is applied to the recording medium 16 in the decurling unit (not shown) by a heating drum (not shown) in the direction opposite from the curl direction in the magazine. The heating temperature at this time is preferably controlled so that the recording medium 16 has a curl in which the surface on which the print is to be made is slightly round outward.

In the case of the configuration in which roll paper is used, a cutter (not shown) is provided, and the continuous paper is cut into a desired size by the cutter. No cutter is required when cut paper is used as shown in FIG. 1.

Also, a main curing device 34 for fixing the ink transferred to the recording medium 16 is provided to the inkjet recording apparatus 10. When using thermal phase-change ink as the ink for forming images, the ink on the recording medium 16 is cooled using the main curing device 34, and the ink is fixed (main curing) on the recording medium 16. 15 The ink transferred to the recording medium 16 can be rapidly fixed to the recording medium 16 by using the main curing device 34 described above, thereby contributing to higher productivity.

Examples of the main curing device 34 include an air cooling method whereby cool air is blown onto the recording medium to forcibly cool the ink on the recording medium 16, and a water cooling method whereby the recording medium 16 with a transferred image is placed in proximity to a circulating conduit for circulating cool water to cool the surface of the recording medium 16. There are also a variety of other cooling methods that may be applied.

Figure 2:
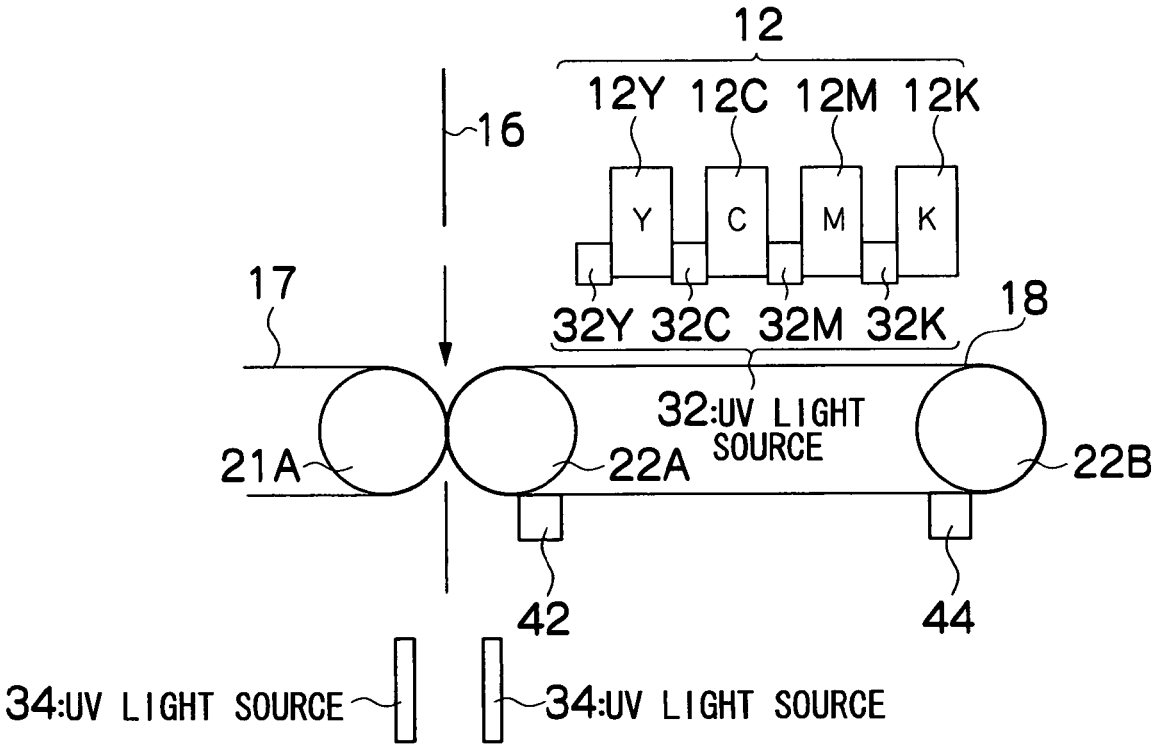
FIG. 2 is a general schematic drawing of an inkjet recording apparatus according to another embodiment of the present invention.

When an ultraviolet (UV) curing ink is used, a UV light source can be employed as the preliminary curing devices 31 and 32 and the main curing device 34 (refer to FIG. 2, shown only in the vicinity of the second head group 12).

For the preliminary curing devices 31 and 32, a UV light source can be used that can impart energy capable of preliminarily curing the ink ejected onto the first transfer belt 17 and the second transfer belt 18 to a viscosity at which mixing with other colors does not occur, and a UV light source is used as the main curing device 34 that can impart energy capable of inducing the final fixing of the image transferred onto the recording medium 16.

Residual ink, dust, waste, and other unwanted material is sometimes left on the first transfer belt 17 and the second transfer belt 18 after image transfer to the recording medium 16 is completed. Cleaning devices 41 and 42 are provided for cleaning the surface of the transfer belts on the downstream side of the movement direction of the transfer belts in the transfer area 26 in order to remove the unwanted matter from the transfer belts.

The details of the configuration of the cleaning devices 41 and 42 are not shown, but a method in which a brush roll, a water absorptive roll, or another roll is nipped; an air blow method that blows clean air; or a combination of these may be adopted. When using a method in which a cleaning roller is nipped, the cleaning effect is considerable if the linear velocities of the belt and roller are varied.

The first transfer belt 17 and the second transfer belt 18 have a width that is greater than the width of the recording medium 16, and a belt with a sufficiently flat surface can be used. Also, a material with good release properties in relation to the ink is used. That is to say, the first transfer belt 17 and the second transfer belt 18 have a prescribed smoothness and flatness, have weak adhesive characteristics with respect to ink, and have an ability to separate from the belt when a prescribed pressure is applied.

The above-described flatness and release properties are provided to at least the image formation area of the first transfer belt 17 and the second transfer belt 18, in which the image is formed by ink ejected from the head groups 11 and 12.

Furthermore, release auxiliary fluid application devices 43 and 44 for applying a silicone fluid or the like to the surface of the belt may be provided in order to enhance the release of the first transfer belt 17 and the second transfer belt 18 from the ink.

The release auxiliary fluid application devices 43 and 44 may be configured to apply a coating fluid while a member impregnated with the auxiliary fluid makes contact with the surface of the belt (application surface), or the coating fluid may be blown onto the surface of the belt by a dispenser or the like. It is also possible to immerse the belt in the auxiliary fluid.

Exemplified in FIG. 1 is an aspect in which a transfer belt is used as the intermediate transfer medium for forming images to be transferred to the recording medium 16, but the image may be formed on the intermediate transfer medium while paper, resin, metal plate (thin plate), or another medium serving as the intermediate transfer medium is conveyed in a relative fashion with respect to the head groups 11 and 12 using a conveyor belt or another conveyance device to transfer the formed image to the recording medium 16.

Paper, resin, metal plates, (thin plates), and other intermediate transfer media may be discarded or cleaned and reused after image transfer.

The print head groups 11 and 12 shown in FIG. 1 form a so-called full-line head in which a line-type head having a length corresponding to the maximum paper width is disposed in the direction orthogonal to the direction of movement of the first transfer belt 17 and the second transfer belt 18. A print head incorporating the print head groups 11 and 12 is composed of a line-type head in which a plurality of ink discharge holes (nozzles) are arrayed across a length exceeding at least one side of a maximum-sized recording medium 16 to be used in the present inkjet recording apparatus 10.

Print heads 11K, 11C, 11M, and 11Y, and print heads 12K, 12C, 12M, and 12Y corresponding to each color are disposed in order of black (K), cyan (C), magenta (M), and yellow (Y) from the upstream side along the direction of movement of the first transfer belt 17 and the second transfer belt 18. A color image can be formed on the first transfer belt 17 and the second transfer belt 18 by discharging colored ink from the print heads 11K, 11C, 11M, and 11Y and the print heads 12K, 12C, 12M, and 12Y while the recording medium 16 is conveyed.

Thus, in accordance with print head groups 11 and 12 in which a full-line head covering the entire width of the paper is provided for each color of ink, an image substantially the size of the entire surface of the recording medium 16 can be recorded onto the first transfer belt 17 and the second transfer belt 18 with a single action (that is, a single pass action) in which the first transfer belt 17, the second transfer belt 18, and the print head groups 11 and 12 are moved in a relative fashion in the direction of movement of the first transfer belt 17 and the second transfer belt 18. In comparison with a shuttle-type head in which the print head moves in a reciprocating fashion in the direction substantially orthogonal (width direction of the transfer belt) to the direction of movement of the first transfer belt 17 and the second transfer belt 18, high-speed printing is thereby made possible, and productivity can be improved.

In the present example, a configuration composed of the standard colors KCMY (four colors) is described, but the present invention is not limited by the combination ink colors and number of colors, and light-colored or dark-colored inks may be added as required. Also possible, for example, is a configuration in which print heads for discharging light cyan, light magenta, or other light-colored inks are added.

Exemplified in the present embodiment is an aspect in which print heads corresponding to a plurality of colors are provided and a color image is formed, but the present invention can also be applied to an aspect in which a print head corresponding to black ink is provided and a black and white image is formed.

Next, the structure of the print heads is described. The print heads 11K, 11C, 11M and 11Y have the same structure, and a reference numeral 50 is hereinafter designated to any of the print heads 11K, 11C, 11M and 11Y.

Figure 3A:
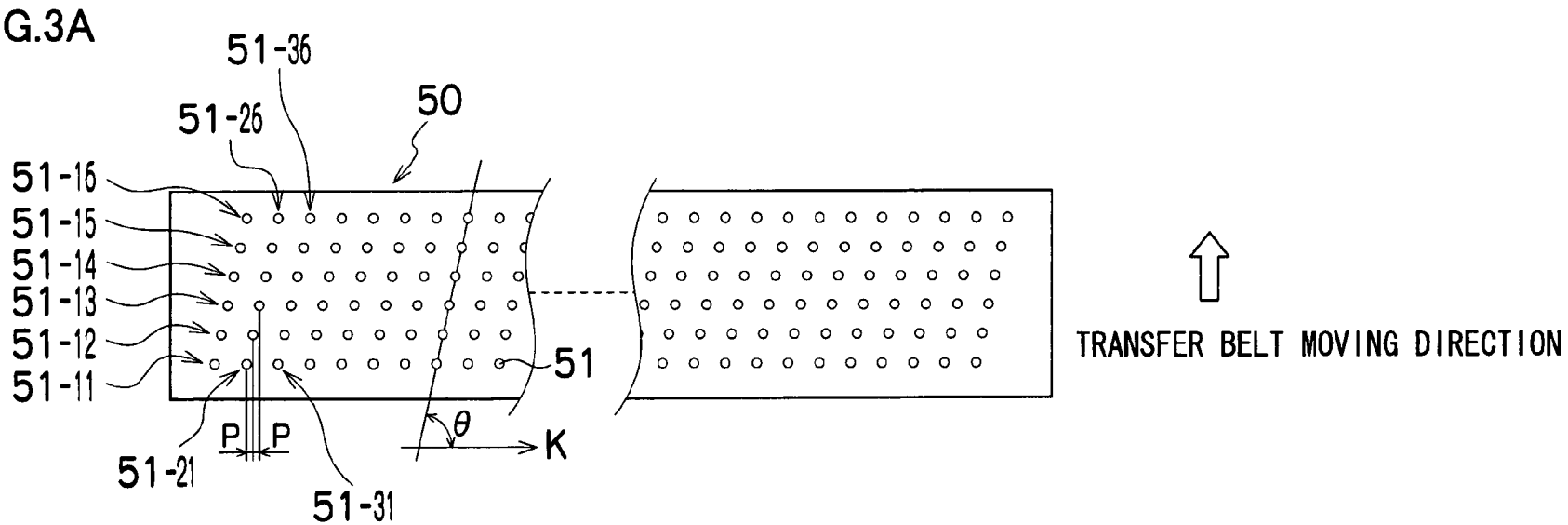
FIG. 3 is a perspective plan view showing a configuration of an ink supply unit in the inkjet recording apparatus.

FIG. 3A is a perspective plan view showing an example of the configuration of the print head 50. The nozzle pitch in the print head 50 should be minimized in order to maximize the density of the dots printed on the surface of the transfer belt. As shown in FIG. 3A, the print head 50 in the present embodiment has a structure in which a plurality of ink chamber units (droplets discharge elements) 53 including nozzles 51 for ejecting ink-droplets and pressure chambers (not shown) connecting to the nozzles 51 are disposed in the form of a staggered matrix, and the effective nozzle pitch is thereby made small.

Thus, as shown in FIG. 3A, the print head 50 in the present embodiment is a full-line head in which one or more of nozzle rows in which the ink discharging nozzles 51 are arranged along a length corresponding to the entire widths of the ink receiving areas of the first transfer belt 17 and the second transfer belt 18 in the direction substantially perpendicular to the moving direction of the first transfer belt 17 and the second transfer belt 18.

Figure 3B:
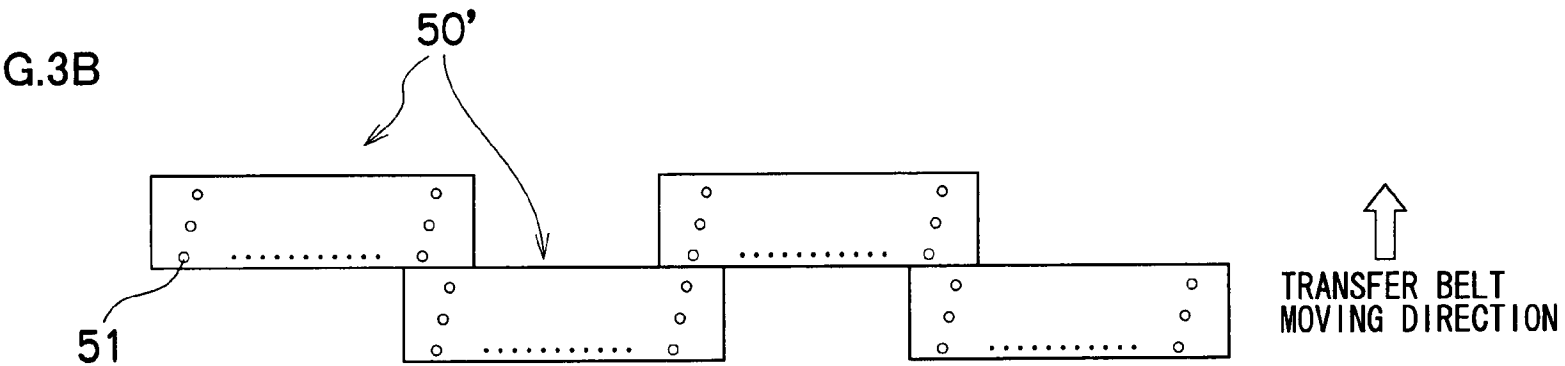

Alternatively, as shown in FIG. 3B, a full-line head can be composed of a plurality of short two-dimensionally arrayed print heads 50' arranged in the form of a staggered matrix and combined so as to form nozzle rows having lengths that correspond to the entire width of the recording medium 16.

As shown in FIGS. 3A and 3B, the plurality of ink chamber units 53 having such a structure are arranged in a grid with a fixed pattern in the line-printing direction along the main scanning direction and in the diagonal-row direction forming a fixed angle θ that is not a right angle with the main scanning direction. With the structure in which the plurality of rows of ink chamber units 53 are arranged at a fixed pitch d in the direction at the angle θ with respect to the main scanning direction, the nozzle pitch P as projected in the main scanning direction is d×cos θ.

Hence, the nozzles 51 can be regarded to be equivalent to those arranged at a fixed pitch P on a straight line along the main scanning direction. Such configuration results in a nozzle structure in which the nozzle row projected in the main scanning direction has a high nozzle density of up to 2,400 nozzles per inch (npi). For convenience of description, described below is a configuration in which the nozzles 51 are linearly arranged with at fixed intervals (pitch P) along the lengthwise direction (main scanning direction) of the head.

When nozzles are driven in a full-line print head having nozzle rows corresponding to the entire width of the ink receiving area of the first transfer belt 17 and the second transfer belt 18, (1) all the nozzles may be simultaneously driven, (2) the nozzles may be driven in order from one side to the other, (3) the nozzles may be divided into blocks and each block may be sequentially driven from one side to the other, or another driving pattern may be used. Main scanning is defined as driving nozzles so that a line composed of a plurality of dots, or a line composed of a single row of dots, is printed in the width direction (direction orthogonal to the direction of movement of the transfer belt) of the first transfer belt 17 and the second transfer belt 18.

In particular, when the nozzles 51 arranged in a matrix such as that shown in FIGS. 3A and 3B are driven, the main scanning according to the above-described (3) is preferred. More specifically, the nozzles 51-11, 51-12, 51-13, 51-14, 51-15 and 51-16 are treated as a block (additionally; the nozzles 51-21, 51-22, . . . , 51-26 are treated as another block; the nozzles 51-31, 51-32, . . . , 51-36 are treated as another block, . . . ); and one line is printed in the width direction of the recording medium 16 by sequentially driving the nozzles 51-11, 51-12, 51-16 in accordance with the conveyance velocity of the recording medium 16.

On the other hand, the "sub-scanning" is defined as to repeatedly perform printing of one line (a line formed of a row of dots, or a line formed of a plurality of rows of dots) formed by the main scanning, while moving the full-line head and the recording paper relatively to each other.

In implementing the present invention, the arrangement of the nozzles is not limited to that of the example illustrated. Moreover, a method is employed in the present embodiment where an ink droplet is ejected by means of the deformation of the actuator, which is typically a piezoelectric element; however, in implementing the present invention, the method used for discharging ink is not limited in particular, and instead of the piezo jet method, it is also possible to apply various types of methods, such as a thermal jet method where the ink is heated and bubbles are caused to form therein by means of a heat generating body such as a heater, ink droplets being ejected by means of the pressure of these bubbles.

Figure 4:
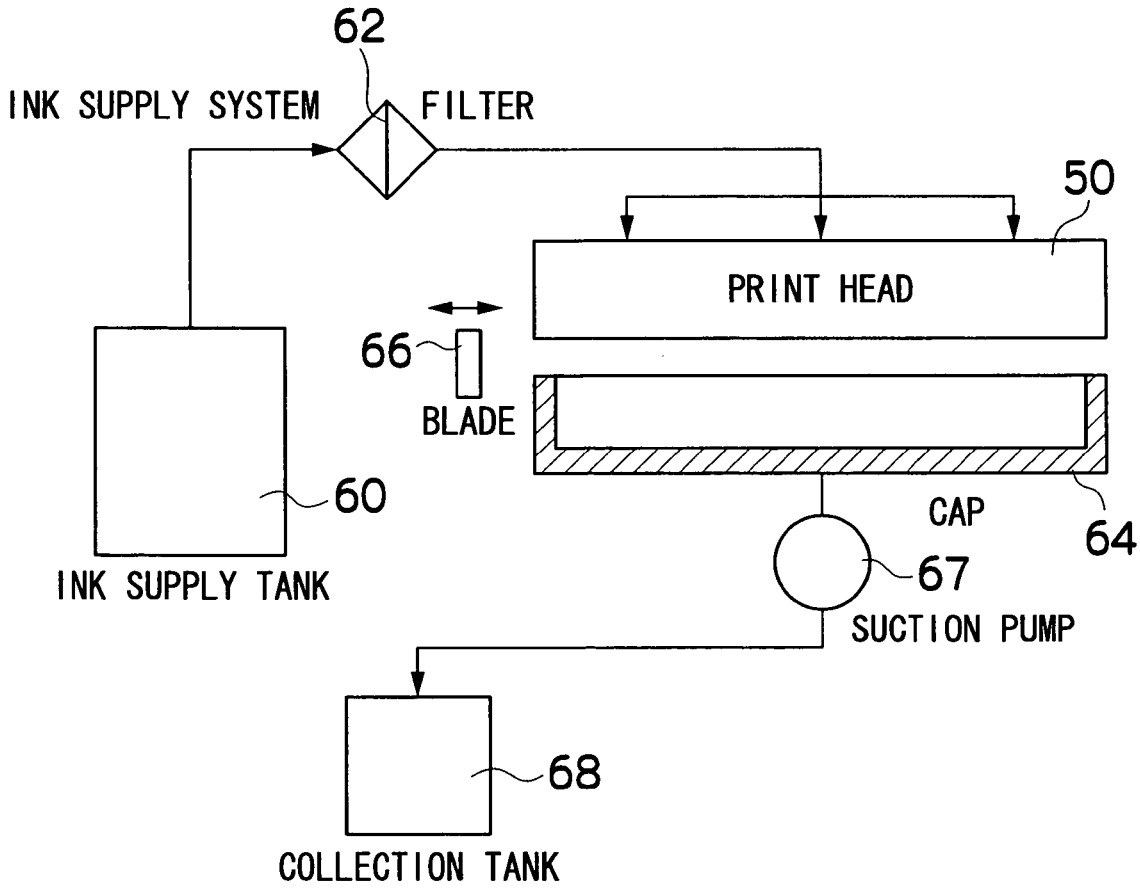
FIG. 4 is a schematic drawing showing a configuration of an ink supply system in the inkjet recording apparatus.

FIG. 4 is a schematic drawing showing the configuration of the ink supply system in the image forming apparatus 10. An ink supply tank 60 is a base tank that supplies ink and is set in the ink storing and loading unit 14 described with reference to FIG. 1. The aspects of the ink supply tank 60 include a refillable type and a cartridge type: when the remaining amount of ink is low, the ink supply tank 60 of the refillable type is filled with ink through a filling port (not shown) and the ink supply tank 60 of the cartridge type is replaced with a new one. In order to change the ink type in accordance with the intended application, the cartridge type is suitable, and it is preferable to represent the ink type information with a bar code or the like on the cartridge, and to perform ejection control in accordance with the ink type. The ink supply tank 60 in FIG. 4 is equivalent to the ink storing and loading unit 14 in FIG. 1 described above.

A filter 62 for removing foreign matters and bubbles is disposed between the ink supply tank 60 and the print head 50 as shown in FIG. 4. The filter mesh size in the filter 62 is preferably equivalent to or less than the diameter of the nozzle and commonly about 20 μm.

Although not shown in FIG. 4, it is preferable to provide a sub-tank integrally to the print head 50 or nearby the print head 50. The sub-tank has a damper function for preventing variation in the internal pressure of the head and a function for improving refilling of the print head.

The image forming apparatus 10 is also provided with a cap 64 as a device to prevent the nozzles 51 from drying out or to prevent an increase in the ink viscosity in the vicinity of the nozzles 51, and a cleaning blade 66 as a device to clean the nozzle face. A maintenance unit including the cap 64 and the cleaning blade 66 can be moved in a relative fashion with respect to the print head 50 by a movement mechanism (not shown), and is moved from a predetermined holding position to a maintenance position below the print head 50 as required.

The cap 64 is displaced up and down in a relative fashion with respect to the print head 50 by an elevator mechanism (not shown). When the power of the image forming apparatus 10 is switched OFF or when in a print standby state, the cap 64 is raised to a predetermined elevated position so as to come into close contact with the print head 50, and the nozzle face is thereby covered with the cap 64.

The cleaning blade 66 is composed of rubber or another elastic member, and can slide on the ink discharge surface (surface of the nozzle plate) of the print head 50 by means of a blade movement mechanism (not shown). When ink droplets or foreign matter has adhered to the nozzle plate, the surface of the nozzle plate is wiped, and the surface of the nozzle plate is cleaned by sliding the cleaning blade 66 on the nozzle plate.

During printing or standby, when the frequency of use of specific nozzles is reduced and ink viscosity increases in the vicinity of the nozzles, a preliminary discharge is made toward the cap 64 to discharge the degraded ink.

Also, when bubbles have become intermixed in the ink inside the print head 50 (inside the pressure chamber), the cap 64 is placed on the print head 50, ink (ink in which bubbles have become intermixed) inside the pressure chamber is removed by suction with a suction pump 67, and the suction-removed ink is sent to a collection tank. This suction action entails the suctioning of degraded ink whose viscosity has increased (hardened) when initially loaded into the head, or when service has started after a long period of being stopped.

When a state in which ink is not ejected from the print head 50 continues for a certain amount of time or longer, the ink solvent in the vicinity of the nozzles 51 evaporates and ink viscosity increases. In such a state, ink can no longer be ejected from the nozzle 51 even if the actuator is operated.

Before reaching such a state the actuator is operated (in a viscosity range that allows discharge by the operation of the actuator), and the preliminary discharge is made toward the ink receptor to which the ink whose viscosity has increased in the vicinity of the nozzle is to be ejected. After the nozzle surface is cleaned by a wiper such as the cleaning blade 66 provided as the cleaning device for the nozzle face, a preliminary discharge is also carried out in order to prevent the foreign matter from becoming mixed inside the nozzles 51 by the wiper sliding operation. The preliminary discharge is also referred to as "dummy discharge", "purge", "liquid discharge", and so on.

More specifically, when bubbles have become intermixed in the ink inside the nozzle 51, ink can no longer be ejected from the nozzles even if the actuator is operated. Also, when the ink viscosity inside the nozzle 51 has increased over a certain level, ink can no longer be ejected from the nozzle 51 even if the actuator is operated. In these cases, a suctioning device to remove the ink inside the pressure chamber by suction with a suction pump, or the like, is placed on the nozzle face of the print head 50, and the ink in which bubbles have become intermixed or the ink whose viscosity has increased is removed to the collection tank 68 by suction.

However, this suction action is performed with respect to all the ink in the pressure chamber, so that the amount of ink consumption is considerable. Therefore, a preferred aspect is one in which a preliminary discharge is performed when the increase in the viscosity of the ink is small.

Figure 5:
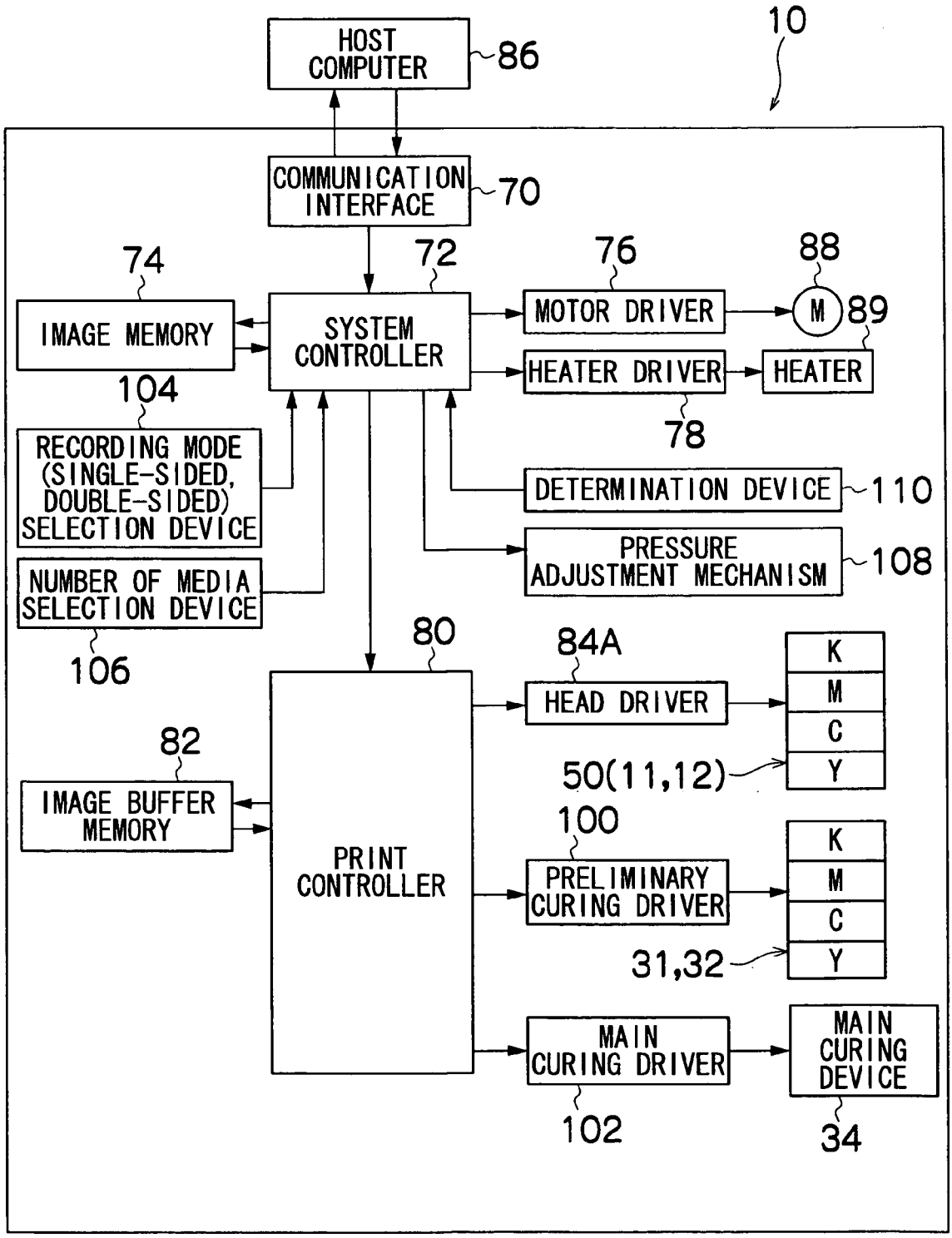
FIG. 5 is a block diagram of principal components showing a system configuration of the inkjet recording apparatus.

FIG. 5 is a block diagram of the principal components showing the system configuration of the image forming apparatus 10. The image forming apparatus 10 has a communication interface 70, a system controller 72, an image memory 74, a motor driver 76, a heater driver 78, a print controller 80, an image buffer memory 82, a head driver 84, a media determination unit 86, a light source control unit 88, and other components.

The communication interface 70 is an interface unit for receiving image data sent from a host computer 86. A serial interface such as USB, IEEE1394, Ethernet, wireless network, or a parallel interface such as a Centronics interface may be used as the communication interface 70. A buffer memory (not shown) may be mounted in this portion in order to increase the communication speed. The image data sent from the host computer 130 is received by the image forming apparatus 10 through the communication interface 70, and is temporarily stored in the image memory 74. The image memory 74 is a storage device for temporarily storing images inputted through the communication interface 70, and data is written and read to and from the image memory 74 through the system controller 72. The image memory 74 is not limited to memory composed of a semiconductor element, and a hard disk drive or another magnetic medium may be used.

The system controller 72 controls the communication interface 70, image memory 74, motor driver 76, heater driver 78, and other components. The system controller 72 has a central processing unit (CPU), peripheral circuits therefor, and the like. The system controller 72 controls communication between itself and the host computer 130, controls reading and writing from and to the image memory 74, and performs other functions, and also generates control signals for controlling a heater 89 and the motor 88 in the conveyance system.

The motor driver 76 is a driver (driver circuit) for driving the motor 88 in accordance with commands from the system controller 72. A motor for driving the rollers 21 and 22 that move the first transfer belt 17 and the second transfer belt 18 is included in the motor 88, and a driver for controlling the motor that drives the rollers 21 and 22 is included in the motor driver 76.

The first transfer belt 17 and the second transfer belt 18 shown in FIG. 1 are synchronized and controlled so that the image formation areas of the first transfer belt 17 and the second transfer belt 18 arrive in the transfer area 26 with the same timing. When an image is furthermore formed in the image formation areas of the first transfer belt 17 and the second transfer belt 18, the recording medium 16 is conveyed in synchronization with the first transfer belt 17 and the second transfer belt 18.

The heater driver 78 is a driver for driving a temperature adjustment device such as a heater 89 of the print head 50 in accordance with commands from the system controller 72.

The print controller 80 has a signal processing function for manipulating, correcting, and performing other procedures for generating a signal for print control from the image data in memory 74 in accordance with the controlling action of the system controller 72, and is a the control unit for feeding the generated print control signal (print data) to the head driver 84. Prescribed signal processing is carried out in the print controller 80, and control of the discharge timing and the discharge amount of ink droplets of the print head 50 is carried out by way of the head driver 84 on the basis of the image data. The desired dot size and dot placement are brought about thereby.

Also, the print controller 80 controls the preliminary curing devices 31 and 32 and main curing device 34 shown in FIG. 1. When a control signal is sent from the print controller 80 to the preliminary curing driver 100 and the main curing driver 102, the preliminary curing driver 100 and main curing driver 102 are driven in accordance therewith, and the preliminary curing devices 31 and 32 and main curing device 34 operate.

The print controller 80 is provided with an image buffer memory 82, and image data, parameters, and other data are temporarily stored in the image buffer memory 82 when image data is processed in the print controller 80. The image buffer memory 82 in FIG. 5 is shown in an aspect in which the memory serves as an auxiliary component to the print controller 80, but it may also double as memory 74. Also possible is an aspect in which the print controller 80 and system controller 72 are brought together and configured as a single processor.

The head driver 84 drives the actuator of the print head 50 of each color on the basis of the print data provided by the print controller 80. The head driver 84 may also include a feedback control system for keeping the driving conditions of the print head 50 fixed.

Control programs are stored in the program storage unit (not shown), control programs are read in accordance with commands of the system controller 72, and the control programs are executed. The program storage unit may use a ROM, EEPROM, or another semiconductor memory, or may use a magnetic disk or the like. An external interface may be provided and a memory card or a PC card may be used. Of these recording media, a plurality of recording media may naturally be provided. The program storage unit may double as a recording device (not shown) for operation parameters and the like.

The present inkjet recording apparatus 10 is controlled so as to discharge the same amount of ink during single-sided recording (when forming an image one either of the transfer belts 17 and 18) and double-sided recording. There is a control method in which the amount of ink used for forming the image on at least the front or reverse side is reduced with the aim of preventing ink offset and cockling during double-sided printing, but since the present inkjet recording apparatus 10 is provided with preliminary curing devices 31 and 32, and ink is preliminarily cured on the first transfer belt 17 and the second transfer belt 18 and then transferred to the recording medium 16, it is not necessary to control the amount of ink.

When single-sided recording is selected by the recording mode selection device 104 for selecting whether to carry out single-sided recording or double-sided recording, control is carried out so as to form an image on either one of the first transfer belt 17 or second transfer belt 18, and conversely, when double-sided recording is selected, control is carried out so as to form prescribed images on the first transfer belt 17 and the second transfer belt 18.

Also provided is a media quantity selection device 106 for selecting whether the quantity of recording media 16 inserted between the first intermediate transfer medium 17 and the second intermediate transfer medium 18 is a single sheet or two sheets, the pressure adjustment mechanism 108 for adjusting the pressure between the roller 21A and roller 22A operates in accordance with the quantity of recording paper inserted between the first transfer belt 17 and the second transfer belt 18, and the pressure between the roller 21A and roller 22A is optimized.

The present inkjet recording apparatus 10 uses a determination device 110 to determine the amount of ink discharge, the thickness of the recording medium 16, and the type of the recording medium 16 fed from the paper supply unit 24, and varies the pressure between the rollers 21A and 22A shown in FIG. 1 by using the pressure adjustment mechanism 108 in accordance with the results of the determination.

Figure 6:
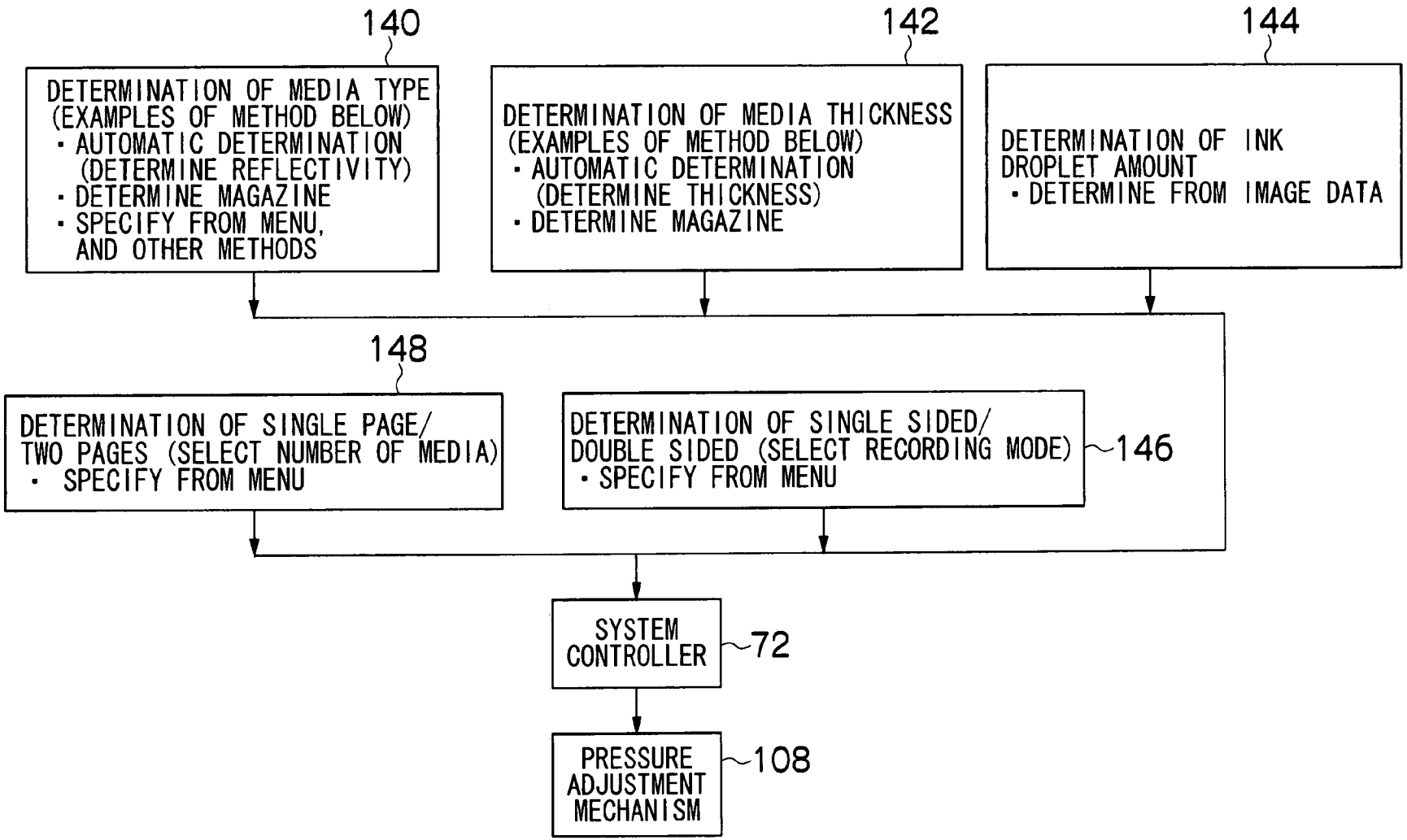
FIG. 6 is a block diagram describing the variable pressure control of the inkjet recording apparatus of the present embodiment.

FIG. 6 is a block diagram showing an example of the variable pressure control.

First, the type of the recording medium is determined in the media type determination unit 140, as shown in FIG. 6. The media type may be determined using automatic determination whereby light is emitted to the recording medium to determine the reflectivity thereof and to make a determination, magazine determination whereby the thickness and other information about the recording medium 16 is read from a barcode or IC tag that contains information about the recording medium and is provided to the magazine or the like for storing the recording medium 16, menu selection whereby the user sets the information using a menu screen, or another method of determining the media type.

When the media type has be determined, the thickness of the recording medium 16 is determined by the media thickness determination unit 142. A sensor for determining the thickness and surface texture of the recording medium is provided for determining the media thickness. To perform this type of determination, it is possible to use automatic determination (thickness determination) that measures the thickness of the recording medium 16, the above-described magazine determination, or another determination method.

Next, the amount of ink droplets is determined from the image data by the ink droplet amount determination unit 144.

Singled-sided printing or double-sided printing is furthermore selected from the menu screen in the single-sided/double-sided determination unit 146 (recording mode selection), and whether the number of recording media 16 to be fed is one or two sheets is selected from the menu screen in the one sheet/two sheet determination unit 148 (media quantity selection).

The determination results of the parameters required for pressure adjustment control thus determined are sent to the system controller 72, the pressure adjustment mechanism thereafter operates in accordance with commands from the system controller 72, and since the pressure of the rollers 21A and 22A are optimized based on the determination results, transfer performance can be improved when transferring images formed on the first transfer belt 17 and the second transfer belt 18 to the recording medium 16, and excellent images can be formed on the recording medium 16.

The transfer pressure applied to the recording medium 16 may be varied depending on the image content of the front and reverse sides of the recording medium 16. In other words, the transfer pressure may be varied in accordance with the amount of ink transferred to the surfaces of the recording medium 16. Also, the pressure applied in single-sided recording and double-sided recording may be varied.

In this configuration, the pressure adjustment mechanism is used to prevent the rollers 21A and 22A from making contact and to keep the rollers in a non-pressure state when the print heads are purged. In other words, when maintenance operation of the print heads is performed, this configuration prevents the ink ejected to one of the transfer belts from making contact with the other transfer belt and soiling the other transfer belt.

To form a non-pressure state, the rollers 21A and 22A may be moved so as to provide clearance between the rollers 21A and 22A, or the entire first transfer belt 17 and the second transfer belt 18 may be moved.

In the inkjet recording apparatus 10 configured as described above, the images transferred to the both sides of the recording medium 16 are formed by discharging ink in the same direction to the intermediate transfer medium to transfer images, and the same image quality can therefore be provided on the front and reverse surfaces in a simple manner.

Since the pressure exerted by the transfer belts on the recording medium 16 is varied in accordance with the thickness, type, and other parameters of the recording medium 16, images having substantially the same quality can be obtained even if the type of recording medium is different. The pressure and spacing between the transfer rollers can be varied in accordance with the amount of ink discharge.

Since the same image is formed during single-sided output as double-sided output, excessive transfer does not occur, and since offsetting, cockling, and other problems are not generated, the printing quality of double-sided printing is stable.

Bleeding and color mixing on the first transfer belt 17 and the second transfer belt 18 can be prevented by bringing the ink ejected onto the transfer belts to a semiliquid sate, and image quality is stable. The transfer performance to the recording medium 16 can furthermore be stabilized by applying a release-enhancing fluid to the first transfer belt 17 and the second transfer belt 18.

Figure 7:
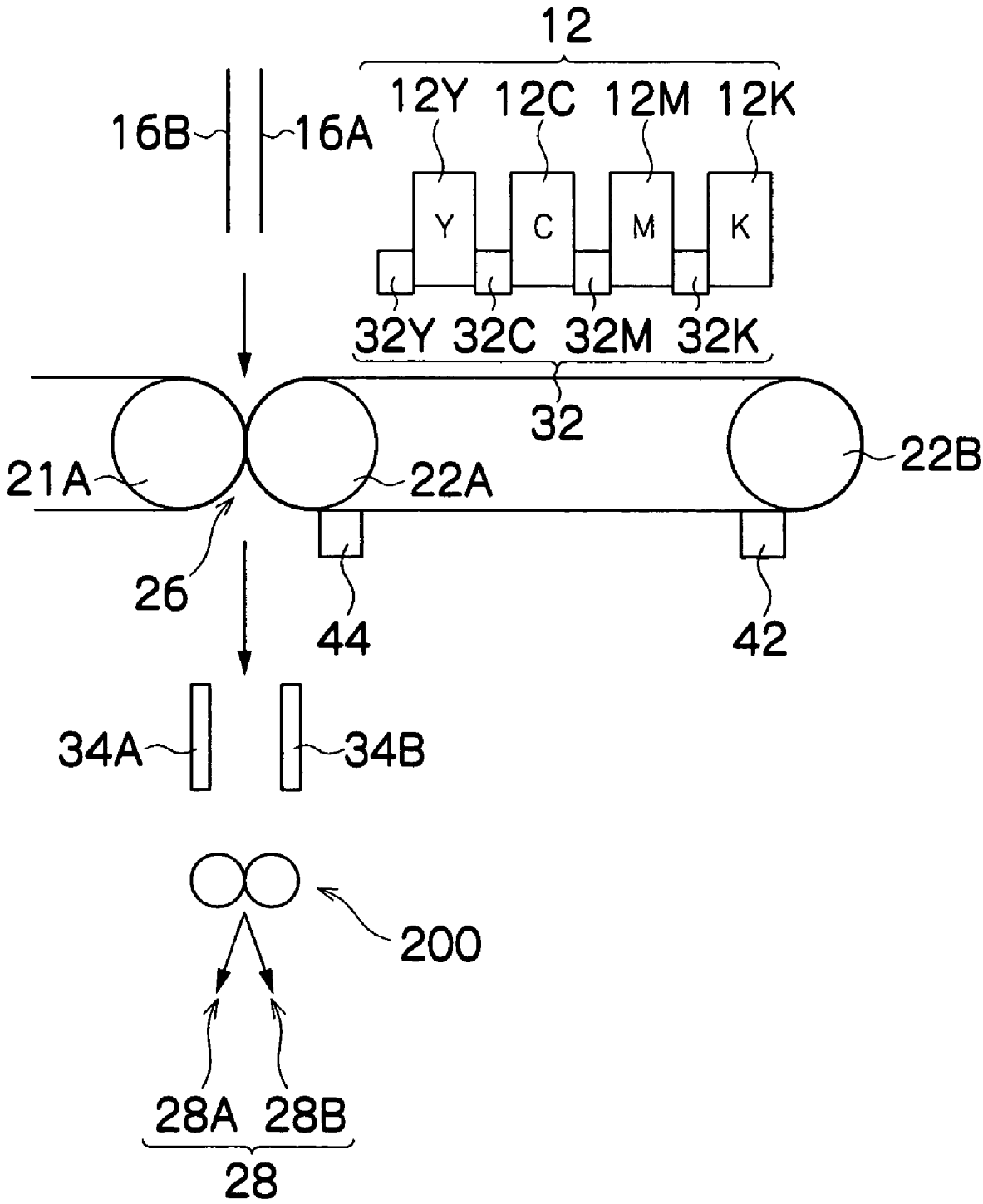
FIG. 7 is a general schematic drawing showing a modification of the inkjet recording apparatus of the present embodiment.

FIG. 7 shows an application example of the present invention. In FIG. 7 the same reference numerals are assigned to identical or similar components as FIG. 1, and a description thereof is omitted.

When the inkjet recording apparatus 10 is not carrying out double-sided printing, two sheets of recording media can be printed at the same time. In other words, when two recording media 16A and 16B are overlaid and fed to the transfer area 26, an image formed on the first transfer belt 17 by the first head group 11 (not shown in FIG. 7) is transferred to recording medium 16A, and an image formed on the second transfer belt by the second head group 12 is transferred to recording medium 16B.

When two sheets of recording media are overlaid and simultaneously fed, the pressure of the rollers 21A and 22A is varied in accordance with the thickness of the two sheets. The two sheets of recording media simultaneously fed may be the same type (thickness) of media or different types of media.

The recording medium 16A to which an image has been transferred from the first transfer belt has the ink transferred thereon fixed by the main curing device 34A, and the recording medium 16B to which an image has been transferred from the second transfer belt has the ink transferred thereon fixed by the main curing device 34B.

When the main fixing procedure is completed for the recording media 16A and 16B, the media are sorted by the sorter 200 and discharged from the discharge units 28A and 28B to the exterior.

The images formed on the recording media 16A and 16B may have the same content or different content. When printing the same content, sorting by the sorter 200 may be omitted.

In accordance with the present modification, higher productivity can be expected because two sheets can be printed simultaneously.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. An image forming apparatus, comprising:

a first inkjet head which ejects ink for forming a first image to be recorded on a recording medium;

a first intermediate transfer medium on which the first image is formed by the ink ejected from the first inkjet head, the first intermediate transfer medium having a structure that includes an elastic body in a first image formation area in which the first image is formed;

a second inkjet head which ejects ink for forming a second image to be recorded on the recording medium;

a second intermediate transfer medium on which the second image is formed by the ink ejected from the second inkjet head, the second intermediate transfer medium having a structure that includes an elastic body in a second image formation area in which the second image is formed; and a transfer recording device which transfers and records the first image and the second image to a first surface of the recording medium in contact with the first image formation area and a second surface of the recording medium in contact with the second image formation area, while holding the recording medium between the first intermediate transfer medium and the second intermediate transfer medium, and conveying the recording medium with respect to the first intermediate transfer medium and the second intermediate transfer medium, wherein the elastic body in the first image formation area is a first transfer belt, and the elastic body in the second image formation area is a second transfer belt, and wherein the transfer recording device comprises a pressure adjustment mechanism which varies a pressure for holding the recording medium between the first intermediate transfer medium and the second intermediate transfer medium;

the image forming apparatus further comprising:

a pressure control device which controls the pressure adjustment mechanism in accordance with at least one parameter of a type of recording medium, a thickness of the recording medium, and a discharge amount of the ink; and a recording mode selection device which selects whether to carry out single-sided recording that records on one surface of the recording medium, or to carry out double-sided recording that records on both surfaces of the recording medium, wherein the pressure control device controls the pressure adjustment mechanism in accordance with a selection result of the recording mode selection device.

2. The image forming apparatus as defined in claim 1, wherein ink discharge directions of the first inkjet head and the second inkjet head are substantially vertically downward, and the first image formation area and the second image formation area form substantially horizontal planes.

3. The image forming apparatus as defined in claim 1, further comprising a preliminary curing device which cures the ink ejected to the first intermediate transfer medium and the second intermediate transfer medium to a semiliquid state with a such viscosity at which mixing with ink of other colors does not occur.

4. The image forming apparatus as defined in claim 3, wherein:

the ink ejected in a molten state from the first inkjet head and the second inkjet head contains a thermal phase-change ink; and the preliminary curing device comprises a heating device which heats at least the first and second image formation areas for keeping the ink ejected to the first and second image formation areas in the semiliquid state.

5. The image forming apparatus as defined in claim 3, wherein:

the ink ejected from the first and second inkjet heads contains photocurable ink; and the preliminary curing device comprises an optical radiation curing device which irradiates at least the first and second image formation areas with light that cures the photocurable ink to cure the ink ejected to the first and second image formation areas in the semiliquid state.

6. The image forming apparatus as defined in claim 3, further comprising a main curing device which cures the ink transferred from the first intermediate transfer medium and the second intermediate transfer medium to the recording medium so that the image is not degraded on the recording medium due to conveyance handling.

7. The image forming apparatus as defined in claim 6, wherein:

the ink ejected in a molten state from the first inkjet head and the second inkjet head contains a thermal phase-change ink; and the preliminary curing device comprises a heating device which heats at least the first and second image formation areas for keeping the ink ejected to the first and second image formation areas in the semiliquid state.

8. The image forming apparatus as defined in claim 7, wherein the main curing device comprises a cooling device which cools the recording medium to fix ink transferred to the recording medium thereto.

9. The image forming apparatus as defined in claim 6, wherein:

the ink ejected from the first and second inkjet heads contains photocurable ink; and the preliminary curing device comprises an optical radiation curing device which irradiates at least the first and second image formation areas with light that cures the photocurable ink to cure the ink ejected to the first and second image formation areas in the semiliquid state.

10. The image forming apparatus as defined in claim 9, wherein the main curing device comprises an optical radiation fixing device which irradiates the recording medium with light that cures the photocurable ink for fixing the ink transferred onto the recording medium to the recording medium.

11. The image forming apparatus as defined in claim 1, wherein the pressure control device controls the pressure adjustment mechanism to bring the first intermediate transfer medium and the second intermediate transfer medium into a non-pressurized state when at least one of the first inkjet head and the second inkjet head is not recording an image and is carrying out maintenance ejection.

12. An image forming method for recording an image to a recording medium, comprising:

a first image formation step for forming at least a first image on a first intermediate transfer medium which comprises an elastic body in a first image formation area in which at least the first image is formed using a first inkjet head from which ink that forms the first image recorded on the recording medium is ejected;

a second image formation step for forming at least a second image on a second intermediate transfer medium which comprises an elastic body in a second image formation area in which at least the second image is formed using a second inkjet head from which ink that forms the second image recorded on the recording medium is ejected; and a transfer step for simultaneously transferring to both sides of the recording medium the first image formed by the first image formation step and the second image formed by the second image formation step while the recording medium is conveyed in a relative fashion with respect to the first intermediate transfer medium and the second intermediate transfer medium, with the recording medium held between the first intermediate transfer medium and the second intermediate transfer medium, wherein the elastic body in the first image formation area is a first transfer belt, and the elastic body in the second image formation area is a second transfer belt, and wherein two recording media are overlaid and conveyed between the first intermediate transfer medium and the second intermediate transfer medium, and images are substantially simultaneously transferred from the first intermediate transfer medium to one of the two recording media, and from the second intermediate transfer medium to the other of the two recording medium;

the image forming method further comprising:

a recording media quantity selection step for selecting whether a quantity of recording media inserted between the first intermediate transfer medium and the second intermediate transfer medium is a single sheet or two sheets, and a pressure adjustment step for adjusting a pressure between the first intermediate transfer medium and the second intermediate transfer medium in accordance with a selection result of the recoding media quantity selection step.

13. An image forming apparatus, comprising:

a first inkjet head which ejects ink for forming a first image to be recorded on a recording medium;

a first intermediate transfer medium on which the first image is formed by the ink ejected from the first inkjet head, the first intermediate transfer medium having a structure that includes an elastic body in a first image formation area in which the first image is formed;

a second inkjet head which ejects ink for forming a second image to be recorded on the recording medium;

a second intermediate transfer medium on which the second image is formed by the ink ejected from the second inkjet head, the second intermediate transfer medium having a structure that includes an elastic body in a second image formation area in which the second image is formed; and a transfer recording device which transfers and records the first image and the second image to a first surface of the recording medium in contact with the first image formation area and a second surface of the recording medium in contact with the second image formation area, while holding the recording medium between the first intermediate transfer medium and the second intermediate transfer medium, and conveying the recording medium with respect to the first intermediate transfer medium and the second intermediate transfer medium, wherein the transfer recording device comprises a pressure adjustment mechanism which varies a pressure for holding the recording medium between the first intermediate transfer medium and the second intermediate transfer medium; and the image forming apparatus further comprising:

a pressure control device which controls the pressure adjustment mechanism in accordance with at least one parameter of a type of recording medium, a thickness of the recording medium, and a discharge amount of the ink, and a recording mode selection device which selects whether to carry out single-sided recording that records on one surface of the recording medium, or to carry out double-sided recording that records on both surfaces of the recording medium, wherein the pressure control device controls the pressure adjustment mechanism in accordance with a selection result of the recording mode selection device.

14. An image forming method for recording an image to a recording medium, comprising:

a first image formation step for forming at least a first image on a first intermediate transfer medium which comprises an elastic body in a first image formation area in which at least the first image is formed using a first inkjet head from which ink that forms the first image recorded on the recording medium is ejected;

a second image formation step for forming at least a second image on a second intermediate transfer medium which comprises an elastic body in a second image formation area in which at least the second image is formed using a second inkjet head from which ink that forms the second image recorded on the recording medium is ejected; and a transfer step for simultaneously transferring to both sides of the recording medium the first image formed by the first image formation step and the second image formed by the second image formation step while the recording medium is conveyed in a relative fashion with respect to the first intermediate transfer medium and the second intermediate transfer medium, with the recording medium held between the first intermediate transfer medium and the second intermediate transfer medium, wherein two recording media are overlaid and conveyed between the first intermediate transfer medium and the second intermediate transfer medium, and images are substantially simultaneously transferred from the first intermediate transfer medium to one of the two recording media, and from the second intermediate transfer medium to the other of the two recording medium, the image forming method further comprising:

a recording media quantity selection step for selecting whether a quantity of recording media inserted between the first intermediate transfer medium and the second intermediate transfer medium is a single sheet or two sheets, and a pressure adjustment step for adjusting a pressure between the first intermediate transfer medium and the second intermediate transfer medium in accordance with a selection result of the recoding media quantity selection step.

* * * * *